US008974992B2

(12) United States Patent
Nakamura et al.

(10) Patent No.: US 8,974,992 B2
(45) Date of Patent: Mar. 10, 2015

(54) ELECTROPHOTOGRAPHIC PHOTORECEPTOR, PROCESS CARTRIDGE, AND IMAGE FORMING APPARATUS

(71) Applicant: Fuji Xerox Co., Ltd., Tokyo (JP)

(72) Inventors: Hirofumi Nakamura, Kanagawa (JP); Jiro Korenaga, Kanagawa (JP); Mitsuhide Nakamura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 64 days.

(21) Appl. No.: 13/871,489

(22) Filed: Apr. 26, 2013

(65) Prior Publication Data

US 2014/0127615 A1 May 8, 2014

(30) Foreign Application Priority Data

Nov. 2, 2012 (JP) ..... 2012-242957

(51) Int. Cl.
*G03G 5/00* (2006.01)
*G03G 5/06* (2006.01)
*G03G 5/14* (2006.01)

(52) U.S. Cl.
CPC ..... *G03G 5/0609* (2013.01); *G03G 5/142* (2013.01); *G03G 5/144* (2013.01)
USPC ..... 430/60; 430/64; 399/159

(58) Field of Classification Search
CPC ..... G03G 5/142
USPC ..... 430/60, 64; 399/159
See application file for complete search history.

(56) References Cited

U.S. PATENT DOCUMENTS

| | | | | |
|---|---|---|---|---|
| 5,419,993 | A | 5/1995 | Sakakibara et al. | |
| 5,663,283 | A | 9/1997 | Sakakibara et al. | |
| 8,673,524 | B2 * | 3/2014 | Nakamura | 430/60 |
| 8,802,337 | B2 * | 8/2014 | Kawasaki et al. | 430/60 |
| 2003/0118927 | A1 | 6/2003 | Nakamura et al. | |
| 2006/0013616 | A1 | 1/2006 | Nukada et al. | |

FOREIGN PATENT DOCUMENTS

| | | |
|---|---|---|
| JP | A-05-011483 | 1/1993 |
| JP | A-05-080572 | 4/1993 |
| JP | A-2002-123028 | 4/2002 |
| JP | A-2003-186219 | 7/2003 |
| JP | A-2006-030698 | 2/2006 |

* cited by examiner

*Primary Examiner* — Mark A Chapman
(74) *Attorney, Agent, or Firm* — Oliff PLC

(57) ABSTRACT

Provided is an electrophotographic photoreceptor including an electroconductive substrate, an undercoat layer that is provided on the electroconductive substrate, contains a binder resin, metal oxide particles and an electron accepting compound having an acidic group and has an AC impedance of from $1\times10^5\Omega$ to $1\times10^8\Omega$ under the measurement condition in which a temperature is 22° C., a humidity is 50% RH, an AC voltage is ±1 V, and a frequency is 1 Hz and an AC impedance of from $1\times10^3\Omega$ to $1\times10^8\Omega$ under the measurement condition in which a temperature is 22° C., a humidity is 50% RH, an AC voltage is ±1 V, and a frequency is 100 Hz, and a photosensitive layer that is provided on the undercoat layer.

12 Claims, 8 Drawing Sheets

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2012-242957 filed Nov. 2, 2012.

BACKGROUND

1. Technical Field

The present invention relates to an electrophotographic photoreceptor, a process cartridge, and an image forming apparatus.

2. Related Art

An electrophotographic image forming apparatus is used in image forming apparatuses such as copying machines and laser beam printers since the electrophotographic image forming apparatus enables high-speed and high-quality printing. In general, photoreceptors used in the image forming apparatuses have been organic photoreceptors using organic photoconductive materials. When manufacturing the organic photoreceptors, for example, in many cases, an undercoat layer (in some cases, also referred to as an intermediate layer) is formed on an aluminum substrate and thereafter a photosensitive layer, in particular, a photosensitive layer composed of a charge generating layer and a charge transporting layer is formed.

SUMMARY

According to an aspect of the invention, there is provided an electrophotographic photoreceptor including an electroconductive substrate, an undercoat layer that is provided on the electroconductive substrate, contains a binder resin, metal oxide particles and an electron accepting compound having an acidic group and has an AC impedance of from $1\times10^5\Omega$ to $1\times10^8\Omega$ under the measurement condition in which a temperature is 22° C., a humidity is 50% RH, an AC voltage is ±1 V, and a frequency is 1 Hz and an AC impedance of from $1\times10^3\Omega$ to $1\times10^8\Omega$ under the measurement condition in which a temperature is 22° C., a humidity is 50% RH, an AC voltage is ±1 V, and a frequency is 100 Hz, and a photosensitive layer that is provided on the undercoat layer.

BRIEF DESCRIPTION OF THE DRAWINGS

Exemplary embodiments of the present invention will be described in detail based on the following figures, wherein.

DETAILED DESCRIPTION

Figure 1:
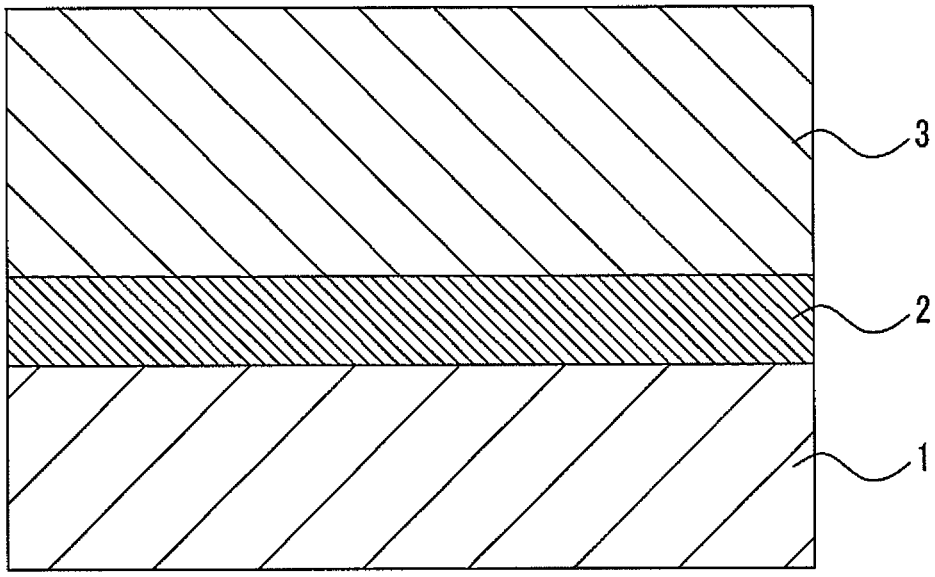
FIG. 1 is a schematic view showing an example of a layer configuration of an electrophotographic photoreceptor according to an exemplary embodiment.

Hereinafter, exemplary embodiments of the invention will be described.

Electrophotographic Photoreceptor

An electrophotographic photoreceptor according to the exemplary embodiment of the invention (hereinafter, simply referred to as a "photoreceptor" in some cases) includes an electroconductive substrate, an undercoat layer provided on the electroconductive substrate, and a photosensitive layer provided on the undercoat layer.

The undercoat layer contains a binder resin, metal oxide particles, and an electron accepting compound having an acidic group.

Moreover, the undercoat layer has an AC impedance of from $1\times10^5\Omega$ to $1\times10^8\Omega$ under the measurement condition in which a temperature is 22° C., a humidity is 50% RH, an AC voltage is ±1 V, and a frequency is 1 Hz and an AC impedance of from $1\times10^5\Omega$ to $1\times10^8\Omega$ under the measurement condition in which a temperature is 22° C., a humidity is 50% RH, an AC voltage is ±1 V, and a frequency is 100 Hz.

Here, recently, for example, a demand for, particularly, the image quality has been increased with respect to photoreceptors for printing market. In order to satisfy this demand, a technique which enables electrical characteristics of the photoreceptor to be stabilized and thus the stability of the image quality to be improved, by mixing a binder resin, metal oxide particles, and an electron accepting compound to the undercoat layer of the electrophotographic photoreceptor and then controlling the resistance of the undercoat layer, has been known.

However, recently, since the diameter of the photoreceptor is reduced by miniaturizing an apparatus and the speed of the apparatus is increased, at present, stabilization of electrical characteristics of the photoreceptor, that is, stabilization of the image quality, specifically, suppression of a ghost (density variation due to history of a preceding cycle) is not sufficiently achieved.

On the other hand, in the photoreceptor according to the exemplary embodiment of the invention, by using the above-described configuration, it is possible to obtain an image in which a ghost (density variation due to history of a preceding cycle) is suppressed.

The reason is not clear but reasons to be described below may be considered.

First, in an image forming process by electrophotography, charging and exposure of the photoreceptor, and transfer are carried out. In this image forming process, if the movement of charge in the undercoat layer of the electrophotographic photoreceptor is focused, it is considered that a hole moves in the undercoat layer at the time of charging and the hole is blocked at the interface between the undercoat layer and the photosensitive layer (for example, the charge generating layer).

Next, at the time of exposing, an electron moves in the undercoat layer toward an electroconductive substrate direction. Then, at the time of transferring, it is considered that a positive electric field is applied, the charge of the surface of the photoreceptor is decreased and then, according to this, a hole in the undercoat layer moves.

In addition, otherwise, before transferring and cleaning, charging is also carried out to the photoreceptor for the purpose of controlling a charging polarity of the toner or the irradiation with erase light is also carried out for the purpose of erasing an accumulated charge. At this time, the charge also moves in the undercoat layer.

In this way, in one image forming process, it is considered that there is one or more of reciprocating movement of the charge in the undercoat layer of the photoreceptor and the undercoat layer is in a state where an AC voltage is applied. Specifically, for example, when the diameter of the photoreceptor is reduced by miniaturizing an apparatus and the speed of the apparatus is increased, it is considered that the undercoat layer is in a state where an AC voltage at a high frequency is applied.

The AC impedance of the undercoat layer means resistance in a state where an AC voltage is applied. That is to say, the AC impedance at a frequency of 1 Hz means the resistance of the undercoat layer in a state where an AC voltage at a low frequency is applied, that is, when an apparatus having a large diameter photoreceptor and a low process speed is employed. On the other hand, the AC impedance at a frequency of 100 Hz means the resistance of the undercoat layer when the diameter of the photoreceptor is reduced and the speed of the apparatus is increased.

If the respective AC impedances at a frequency of 1 Hz and a frequency of 100 Hz of the undercoat layer are adjusted to the resistance having the above-described range, the blocking property of the charge is obtained while suppressing an image quality defect by making the movement of the charge smooth. That is, when the resistance is excessively low, it is considered that the blocking property of the charge is degraded at the time of charging and thus fogging or black spots become worse.

According to this, in the photoreceptor according to the exemplary embodiment of the invention, it is possible to obtain an image in which a ghost (density variation due to history of a preceding cycle) is suppressed. In particular, even in a case where the diameter of the photoreceptor is reduced and the speed of the apparatus is increased, it is possible to suppress a ghost over a long period of time.

In addition, in the photoreceptor according to the exemplary embodiment of the invention, since the increase in the residual potential is also suppressed, cycle characteristics of the photoreceptor potential is improved (the variation of the photoreceptor potential due to repetitive use is suppressed). As a result, for example, it is easy to realize the longer lasting electrophotographic photoreceptor or to suppress the density unevenness of a halftone image.

Particularly, in the image forming apparatus (process cartridge) including a contact type charging unit, it is considered that a local discharge occurs easily and, when an in-plane ununiformity of the undercoat layer is significant, an abnormal discharge occurs more easily.

Therefore, in the image forming apparatus (process cartridge) including a contact type charging unit, a fogging (phenomenon in which toner is attached to a non-image portion) is easily generated. However, when the electrophotographic photoreceptor according to the exemplary embodiment of the invention is applied, the undercoat layer has the AC impedance in the above-described range. Therefore, it is considered that leakage preventive properties of the undercoat layer are also improved and thus it is possible to obtain an image in which the fogging is suppressed.

Hereinafter, the electrophotographic photoreceptor according to the exemplary embodiment of the invention will be described with reference to the drawings.

FIGS. 1 to 6 are schematic views showing a layer configuration of the photoreceptor according to the exemplary embodiment of the invention. The photoreceptor shown in FIG. 1 is configured to include an electroconductive substrate 1, an undercoat layer 2 formed on the electroconductive substrate 1 and a photosensitive layer 3 formed on the undercoat layer 2.

Figure 2:
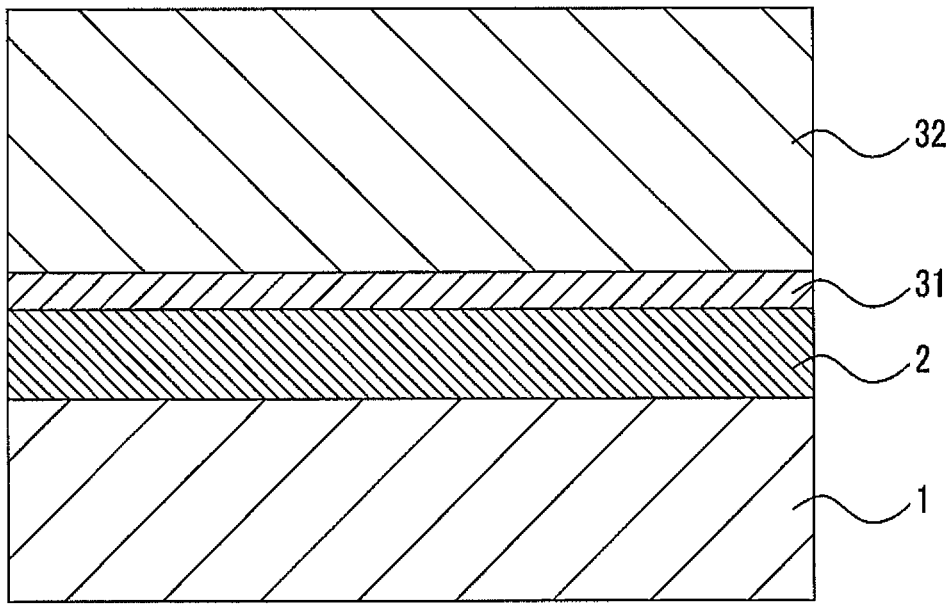
FIG. 2 is a schematic view showing another example of a layer configuration of the electrophotographic photoreceptor according to the exemplary embodiment of the invention.
Figure 3:
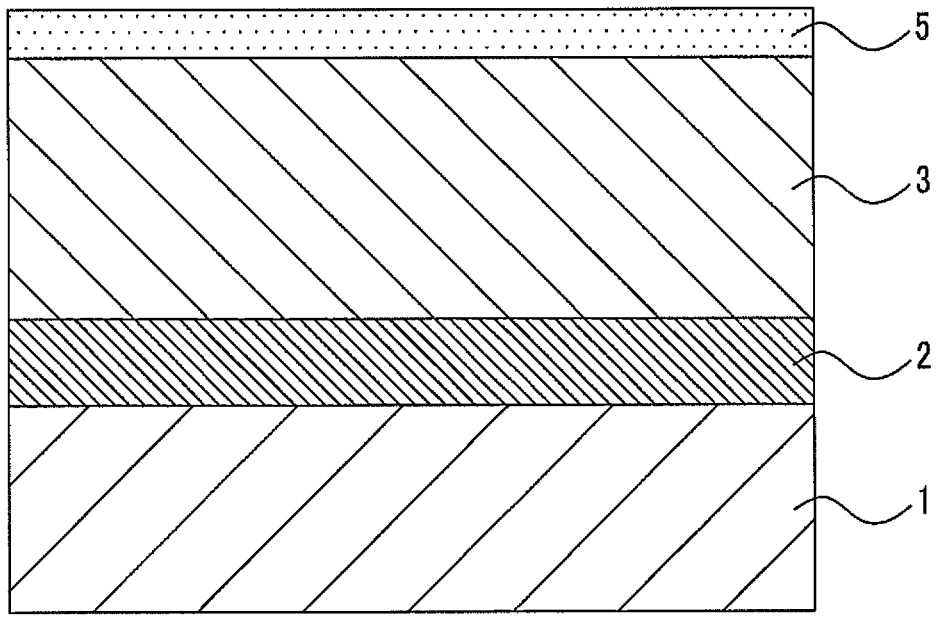
FIG. 3 is a schematic view showing another example of a layer configuration of the electrophotographic photoreceptor according to the exemplary embodiment of the invention.
Figure 4:
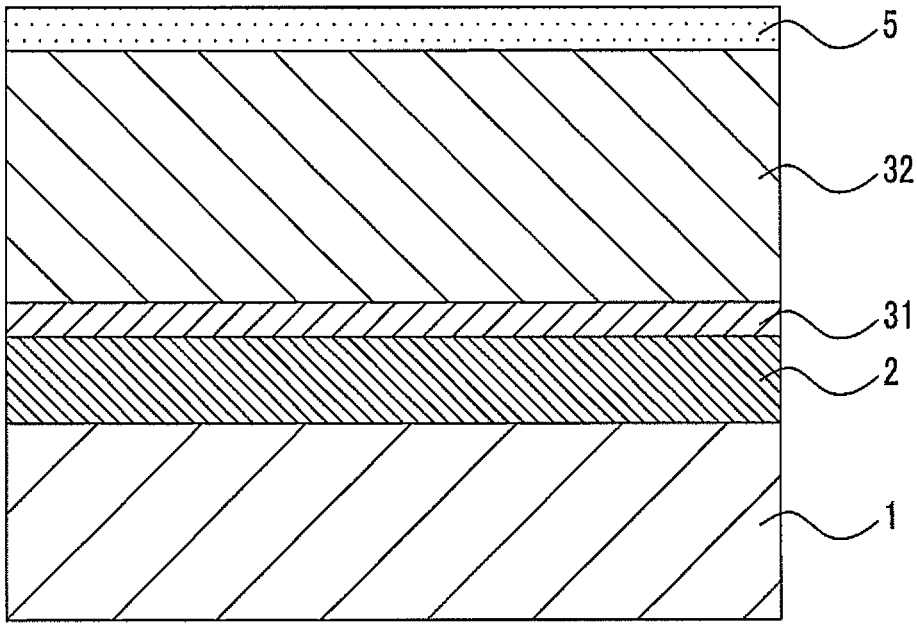
FIG. 4 is a schematic view showing another example of a layer configuration of the electrophotographic photoreceptor according to the exemplary embodiment of the invention.
Figure 5:
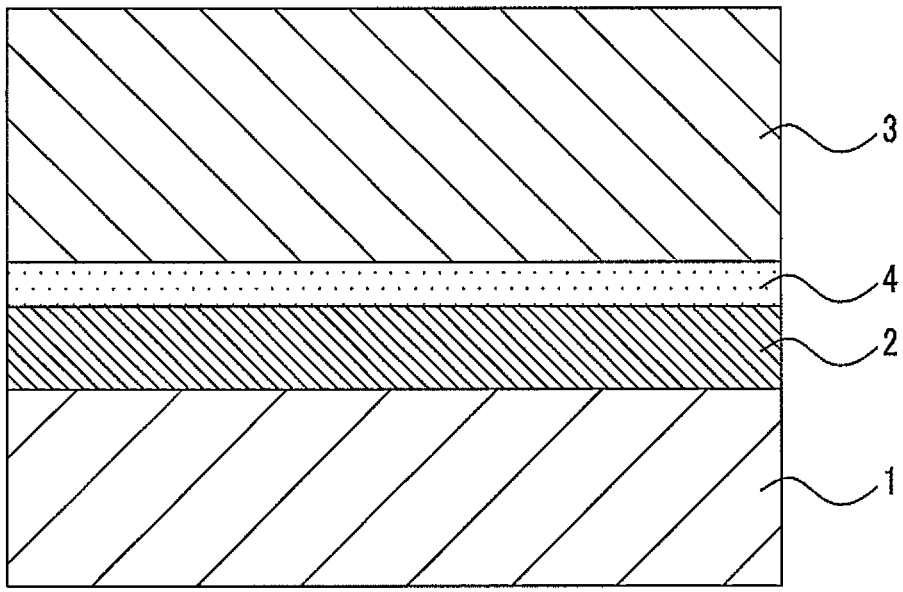
FIG. 5 is a schematic view showing another example of a layer configuration of the electrophotographic photoreceptor according to the exemplary embodiment of the invention.
Figure 6:
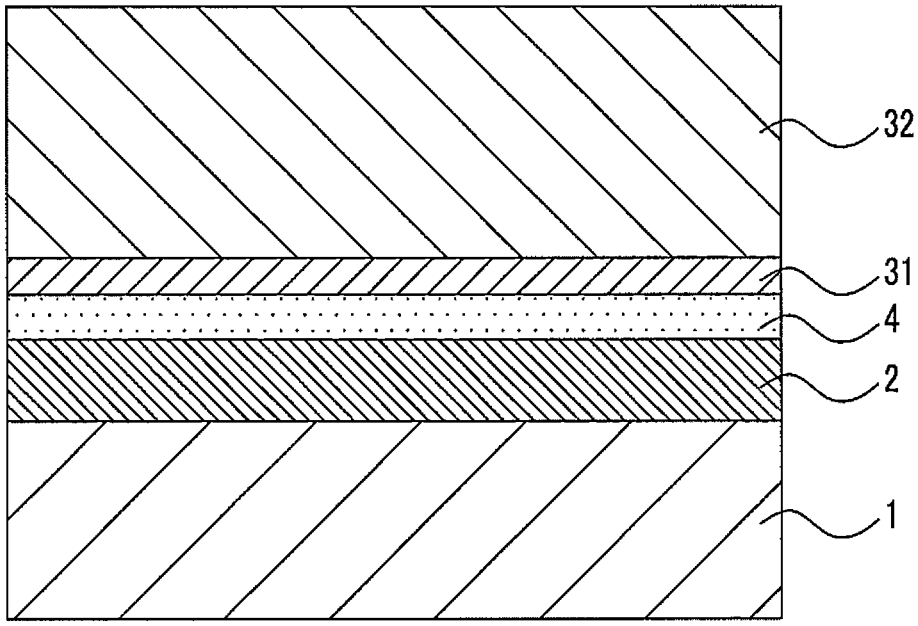
FIG. 6 is a schematic view showing another example of a layer configuration of the electrophotographic photoreceptor according to the exemplary embodiment of the invention.

In addition, as shown in FIG. 2, the photosensitive layer 3 may have a two-layer structure of a charge generating layer 31 and a charge transporting layer 32. Moreover, as shown in FIGS. 3 and 4, a protective layer 5 may be provided on the photosensitive layer 3 or the charge transporting layer 32. Further, as shown in FIGS. 5 and 6, an intermediate layer 4 may be provided between the undercoat layer 2 and the photosensitive layer 3 or between the undercoat layer 2 and the charge generating layer 31.

The aspect in which the intermediate layer 4 is provided between the undercoat layer 2 and the photosensitive layer 3 or between the undercoat layer 2 and the charge generating layer 31 is shown but the intermediate layer 4 may be provided between the electroconductive substrate 1 and the undercoat layer 2. Of course, an aspect in which the intermediate layer 4 is not provided may be employed.

Next, each element of the electrophotographic photoreceptor will be described. The description will be given while omitting reference numerals.

Electroconductive Substrate

As the electroconductive substrate, any one used from the past may be used. Examples of the electroconductive substrate include resin films having a thin film (for example, metals such as aluminum, nickel, chromium, or stainless steel, and films such as aluminum, titanium, nickel, chromium, stainless steel, gold, vanadium, tin oxide, indium oxide, indium-tin oxide (ITO), or the like), and the like, paper coated or impregnated with a conductivity-imparting agent, resin films coated or impregnated with a conductivity-imparting agent, and the like. The shape of the substrate is not limited to a cylindrical shape and may be a sheet shape or a plate shape.

When a metal pipe is used as the electroconductive substrate, the surface of the pipe may be in an untreated state or may be subjected to a treatment such as mirror surface cutting, etching, anodic oxidation, rough cutting, centerless grinding, sandblast, wet honing, or the like.

Undercoat Layer

AC Impedance

The undercoat layer has an AC impedance of from $1\times10^5\Omega$ to $1\times10^8\Omega$ under the measurement condition in which a temperature is 22° C., a humidity is 50% RH, an AC voltage is ±1 V and a frequency is 1 Hz. Form the viewpoint of suppressing a ghost, the AC impedance is preferably from $1\times10^4\Omega$ to $1\times10^7\Omega$.

On the other hand, the undercoat layer has an AC impedance of from $1\times10^3\Omega$ to $1\times10^8\Omega$ under the measurement condition in which a temperature is 22° C., a humidity is 50% RH, an AC voltage is ±1 V and a frequency is 100 Hz. Form the viewpoint of suppressing a ghost, the AC impedance is preferably from $5\times10^3\Omega$ to $1\times10^7\Omega$.

Moreover, it is preferable that the undercoat layer have an AC impedance in a range from $1\times10^3\Omega$ to $1\times10^8\Omega$, in the frequency range from 1 Hz to 100 Hz.

The AC impedance of the undercoat layer at each frequency is adjusted by, for example, 1) types of the metal oxide particles and the electron accepting compound, 2) the added amount or particle size of the metal oxide particles, 3) types and treatment amount of surface treatment agent of the metal oxide particles, 4) a dispersion state of the metal oxide particles, and 5) a drying condition (drying time and drying temperature) of the undercoat layer.

In addition, as the particle size of the metal oxide particles becomes larger, the AC impedance of the undercoat layer tends to be decreased. Moreover, as the added amount of the metal oxide particles becomes larger, the AC impedance of the undercoat layer tends to be increased.

Further, as the dispersibility of the metal oxide particles is improved, the AC impedance of the undercoat layer tends to be increased. Specifically, as the dispersion treatment time of the coating liquid for forming an undercoat layer becomes longer, the AC impedance of the undercoat layer tends to be increased.

The measurement method of the AC impedance is as follows.

First, coating films, such as a charge generating layer and a charge transporting layer, with which the undercoat layer is covered are removed from the electrophotographic photoreceptor using a solvent (for example, acetone, tetrahydrofuran, methanol, ethanol, or the like) and gold electrodes are provided onto the exposed undercoat layer by a vacuum deposition method, a sputtering method, or the like. Thus, an undercoat layer sample for measuring is obtained.

Using the undercoat layer sample, the measurement is carried out by using an impedance analyzer 126096W type (manufactured by Solartron) under the measurement condition (temperature of 22° C., humidity of 50% RH, AC voltage ±1 V (DC voltage 0 V) and frequency of 1 Hz or 100 Hz) and thus the AC impedance at each frequency is obtained.

Configuration

The undercoat layer is configured to include a binder resin, metal oxide particles, and an electron accepting compound.

Binder Resin

Examples of the binder resin include polymer resin compounds such as acetal resins (for example, polyvinyl butyral or the like), polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenolic resins, phenol-formaldehyde resins, melamine resins, and the like. In addition, resins obtained by a reaction between these resins and a curing agent are also exemplified.

Metal Oxide Particles

Examples of the metal oxide particles include antimony oxide particles, indium oxide particles, tin oxide particles, titanium oxide particles, zinc oxide particles, and the like.

Among these, as the metal oxide particles, tin oxide particles, titanium oxide particles, zinc oxide particles are preferable, from the viewpoint of suppressing a ghost. Zinc oxide particles are more preferable.

As the metal oxide particles, electroconductive powder having a particle size of preferably 100 nm or smaller and, particularly, electroconductive powder having a particle size of from 10 nm to 100 nm are preferably used. Here, the particle size refers to an average primary particle size. The average primary particle size of the metal oxide particles is a value measured by observation using SEM (Scanning Electron Microscope).

When the particle size of the metal oxide particles is 10 nm or smaller, the surface area of the metal oxide particles is increased and thus the uniformity of the dispersion is degraded in some cases. On the other hand, when the particle size of the metal oxide particles exceeds 100 nm, it may be assumed that secondary particles or higher order particles have a particle size of approximately 1 μm and thus the undercoat layer has a portion containing the metal oxide particles and a portion not containing the metal oxide particles therein, that is, tends to have a sea-island structure. Therefore, for example, an image quality defect such as non-uniformity of the halftone density is generated in some cases.

It is preferable that the metal oxide particles have a powder resistance of from $10^4\Omega\cdot$cm to $10^{10}\Omega\cdot\mu$cm. This makes it easy to realize that the undercoat layer obtains appropriate impedance at the frequency corresponding to the electrophotographic process speed.

When the resistance value of the metal oxide particles is lower than $10^4\Omega\cdot$cm, the impedance gradient to the dependency on added amount of particles may be too large and thus it may be difficult to control the impedance in some cases. On the other hand, when the resistance value of the metal oxide particles is higher than $10^{10}\Omega\cdot$cm, the residual potential may be increased in some cases.

The metal oxide particles may be preferably subjected to a surface treatment with at least one kind of coupling agents, for the purpose of improving characteristics such as dispersibility, as necessary.

Examples of the coupling agents include at least one kind selected from silane coupling agents, titanate coupling agents, and aluminate coupling agents.

Specific examples of the coupling agents include silane coupling agents such as vinyltrirmethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, and γ-chloropropyltrimethoxysilane; aluminate coupling agents such as acetoalkoxy aluminum diisopropylate; titanate coupling agents such as isopropyltriisostearoyltitanate, bis(dioctyl pyrophosphate), and isopropyltri(N-aminoethyl-aminoethyl)titanate; and the like but are not limited thereto. These coupling agents may be used as a mixture of two or more kinds thereof.

The treatment amount of the coupling agent may be from 0.1% by weight to 3% by weight, preferably from 0.3% by weight to 2.0% by weight and more preferably from 0.5% by weight to 1.5% by weight, with respect to the metal oxide particles.

The treatment amount of the coupling agent is measured as follows.

Examples of the measurement method include analysis methods such as a FT-IR method, a 29Si solid state NMR method, a thermal analysis method, and an XPS method and a FT-IR method is the simplest. In the FT-IR method, a general KBr pellet method or an ATR method may be used. The treatment amount of the coupling agent is measured by mixing a small quantity of the treated metal oxide particles with KBr and then measuring FT-IR.

After performing the surface treatment using the above-described coupling agent, the metal oxide particles may be subjected to the heat treatment, as necessary, in order to improve an environmental dependency of resistance values or the like. The heat treatment temperature may preferably be, for example, from 150° C. to 300° C. and the treatment time may preferably be from 30 minutes to 5 hours.

From the viewpoint of maintaining electrical characteristics, the content of the metal oxide particles is preferably from 30% by weight to 60% by weight and more preferably from 35% by weight to 55% by weight.

Electron Accepting Compound

The electron accepting compound is a material which chemically reacts with the surface of the metal oxide particles contained in the undercoat layer or a material which is adsorbed onto the surface of the metal oxide particles. The electron accepting compound may be selectively present on the surface of the metal oxide particles.

As the electron accepting compound, an electron accepting compound having an acidic group is applied. Examples of the acidic group include a hydroxyl group (phenolic hydroxyl group), a carboxyl group, a sulfonyl group and the like.

Specific examples of the electron accepting compound include a quinone compound, an anthraquinone compound, a coumarin compound, a phthalocyanine compound, a triphenylmethane compound, an anthocyanin compound, a flavone compound, a fullerene compound, a ruthenium complex, a xanthene compound, a benzoxazine compound, and a porphyrin compound. In particular, as the electron accepting compound, an anthraquinone material (anthraquinone derivative) is preferable in consideration of suppressing a ghost and safety, availability and electron transporting property of the material. In particular, the compound represented by the following Formula (1) is preferable.

Formula (1)

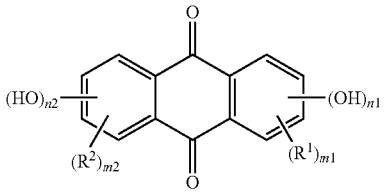

In Formula (1) n1 and n2 each independently represent an integer of from 0 to 3, provided that at least one of n1 and n2 represents an integer of from 1 to 3 (that is, n1 and n2 do not represent 0 at the same time). m1 and m2 each independently represent an integer of 0 or 1. $R^1$ and $R^2$ each independently represent an alkyl group having from 1 to 10 carbon atoms or an alkoxy group having from 1 to 10 carbon atoms.

The electron accepting compound may be the compound represented by the following Formula (2).

Formula (2)

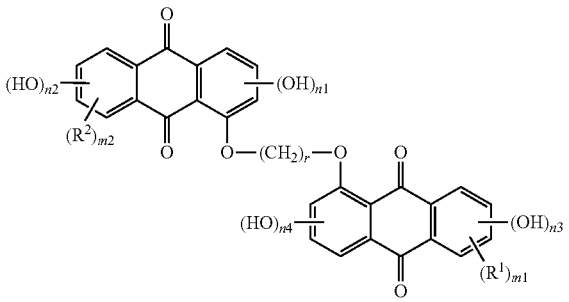

In Formula (2), n1, n2, n3, and n4 each independently represent an integer of from 0 to 3, provided that at least one of n1 and n2 represents an integer of from 1 to 3 (that is, n1 and n2 do not represent 0 at the same time). In addition, at least one of n3 and n4 represents an integer of from 1 to 3 (that is, n3 and n4 do not represent 0 at the same time). m1 and m2 each independently represent an integer of 0 or 1. r represents an integer of from 2 to 10. $R^1$ and $R^2$ each independently represent an alkyl group having from 1 to 10 carbon atoms or an alkoxy group having from 1 to 10 carbon atoms.

In Formulae (1) and (2), as the alkyl group having from 1 to 10 carbon atoms represented by $R^1$ and $R^2$, any of linear and branched alkyl groups may be used. Examples thereof include a methyl group, an ethyl group, a propyl group, an isopropyl group and the like. As the alkyl group having from 1 to 10 carbon atoms, an alkyl group having from 1 to 8 carbon atoms is preferable and an alkyl group having from 1 to 6 carbon atoms is more preferable.

As the alkoxy group (alkoxyl group) having from 1 to 10 carbon atoms represented by $R^1$ and $R^2$, any of linear and branched alkoxy groups may be used. Examples thereof include a methoxy group, an ethoxy group, a propoxy group, an isopropoxy group and the like. As the alkoxy group having from 1 to 10 carbon atoms, an alkoxy group having from 1 to 8 carbon atoms is preferable and an alkoxy group having from 1 to 6 carbon atoms is more preferable.

Specific examples of the electron accepting compound will be described below, but the electron accepting compound is not limited thereto.

1-1

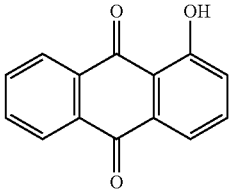

1-2

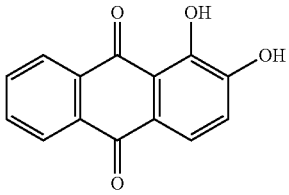

1-3

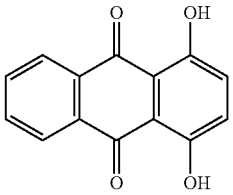

1-4

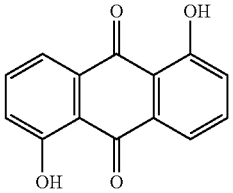

1-5

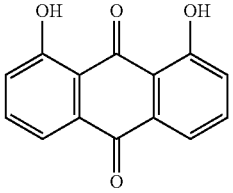

-continued
1-6
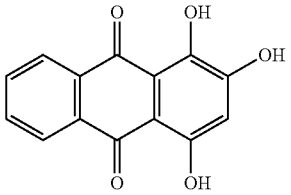
1-7
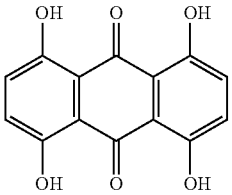
1-8
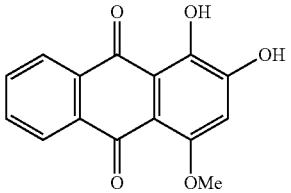
1-9
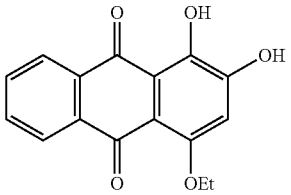
1-10
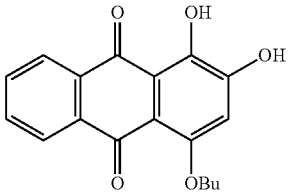
1-11
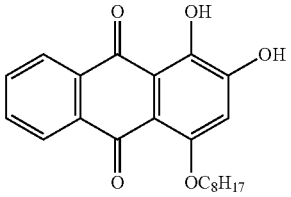
1-12
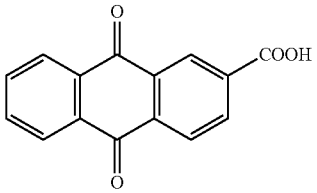
-continued
1-13
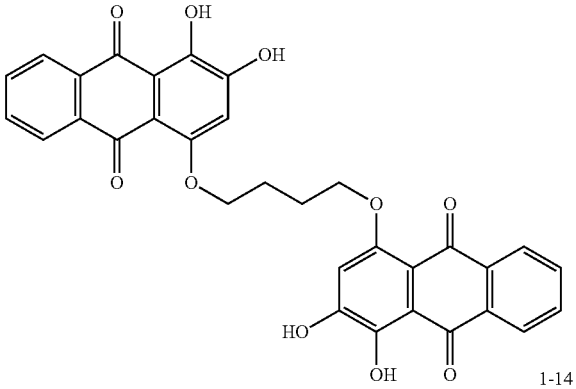
1-14
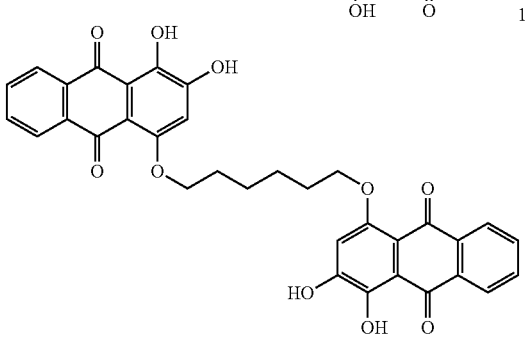
1-15
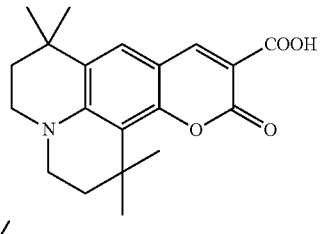
1-16
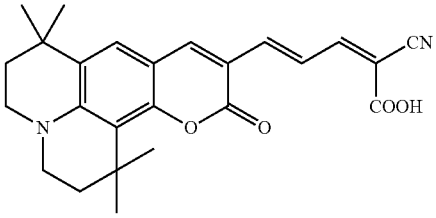
1-17
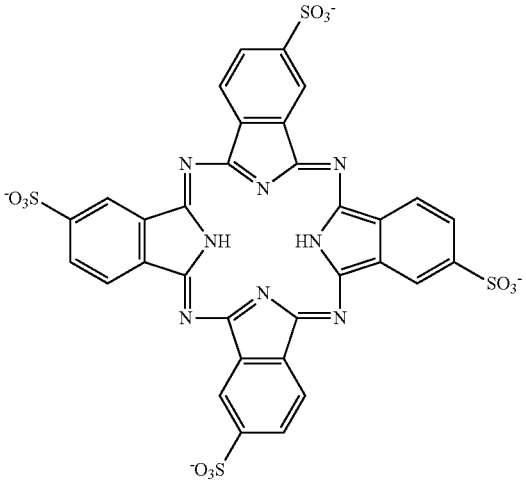

-continued 1-18

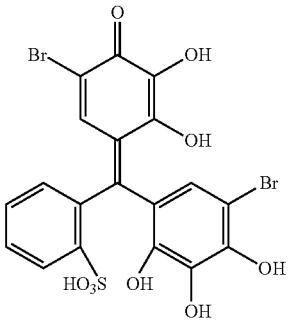

1-19

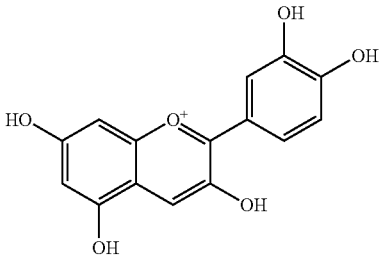

1-20

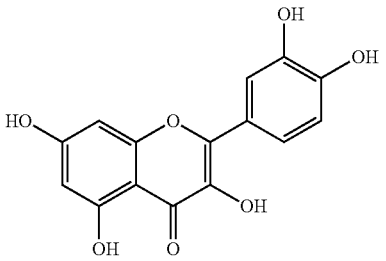

1-21

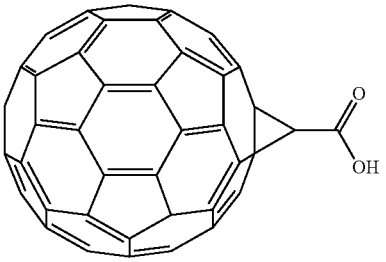

1-22

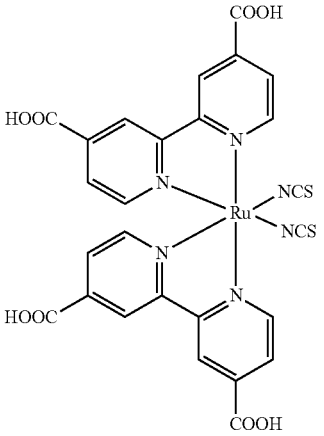

The content of the electron accepting compound is determined depending on the surface area and content of the metal oxide particles with or onto which the electron accepting compound chemically reacts or be adsorbed, and an electron transporting property of each material. However, generally, the content of the electron accepting compound is preferably in a range from 0.01% by weight to 20% by weight and more preferably in a range from 0.1% by weight to 10% by weight.

When the content of the electron accepting compound is 0.1% by weight or less, it may be difficult to develop an effect of the electron accepting compound. On the other hand, when the content of the electron accepting compound exceeds 20% by weight, the aggregation between metal oxide particles easily occurs. Therefore, it is easy for the metal oxide particles to be ununiformly distributed in the undercoat layer and thus it may be difficult to form a good electroconductive path. According to this, the residual potential is increased and a ghost is generated. Moreover, in some cases, black spots and unevenness of halftone density may be generated.

Other Additives

As other additives, resin particles are exemplified. When coherent light such as laser light is used for the exposure device, the preventing of a moire image may be preferably carried out. In order to prevent a moire image, the surface roughness of the undercoat layer may be preferably adjusted in a range from 1/4n (n is a refractive index of the upper layer) to 1/2λ, in which λ represents the wavelength of the laser for exposure to be used. In this case, when the resin particles are added into the undercoat layer, the adjusting of the surface roughness thereof is realized. Examples of the resin particles include silicone resin particles, crosslinked poly methyl methacrylate (PMMA) resin particles and the like.

In addition, other additives are not limited to the above-described examples and well-known additives may be also exemplified.

Formation of Undercoat Layer

When forming the undercoat layer, the coating liquid for forming an undercoat layer obtained by adding the above-described components to the solvent is used. The coating liquid for forming an undercoat layer may be obtained, for example, by dispersing the preliminary mixed or preliminary dispersed metal oxide particles, as necessary, electron accepting compound and other additives, in the binder resin.

As the solvent for obtaining the coating liquid for forming an undercoat layer, well-known organic solvents, which dissolve the above-described binder resin, such as alcohol-based, aromatic-based, hydrocarbon halide-based, ketone-based, ketone alcohol-based, ether-based, and ester-based solvents. These solvents may be used alone or as a mixture of two or more kinds thereof.

As a method for dispersing the metal oxide particles in the coating liquid for forming an undercoat layer, well-known dispersing methods are used. Examples thereof include methods using a roll mill, a ball mill, a vibration ball mill, an attritor, a sand mill, a colloid mill, a paint shaker and the like.

Examples of the method for coating the coating liquid for forming an undercoat layer include a dip coating method, a blade coating method, a wire bar coating method, a spray coating method, a bead coating method, an air knife coating method, a curtain coating method, and the like.

The Vickers hardness of the undercoat layer is preferably from 35 to 50.

From the viewpoint of suppressing an image ghost, the thickness of the undercoat layer is preferably 15 μm or more, more preferably from 15 μm to 30 μm and still more preferably 20 μm to 25 μm.

Intermediate Layer

The intermediate layer is provided, for example, between the undercoat layer and the photosensitive layer as necessary, in order to improve electrical characteristics, image quality, image quality maintaining properties, photosensitive layer adhesion properties and the like. In addition, the intermediate layer may be provided between the electroconductive substrate and the undercoat layer.

Examples of the binder resins used for the intermediate layer include organic metal compounds containing zirconium atoms, titanium atoms, aluminum atoms, manganese atoms, silicon atoms, or the like, in addition to polymer resin compounds, for example, an acetal resin (such as polyvinyl butyral), a polyvinyl alcohol resin, casein, a polyamide resin, a cellulose resin, gelatin, a polyurethane resin, a polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a phenol-formaldehyde resin, a melamine resin, or the like. These compounds can be used singly or as a mixture or polycondensation product of plural compounds. Among them, organic metal compounds containing zirconium or silicon are suitable from the viewpoints of a low residual potential, a low potential variation due to environment, a small change in potential due to repetitive use, and the like.

When the intermediate layer is formed, coating liquid for forming an intermediate layer obtained by adding the above-described components to the solvent is used.

Examples of the coating method for forming the intermediate layer include usual methods such as a dip coating method, an extrusion coating method, a wire bar coating method, a spray coating method, a blade coating method, a knife coating method, a curtain coating method, and the like.

In addition, the intermediate layer also functions as an electric blocking layer, in addition to functioning to improve the coating property of the upper layer. However, when the film thickness of the intermediate layer is too large, an electric hindrance may become too strong, causing desensitization or increase in an electric potential due to repetitive use. Accordingly, when the intermediate layer is formed, the film thickness thereof is preferably set in a range from 0.1 μm to 3 μm. Further, in this case, the intermediate layer may also be used as the undercoat layer.

Charge Generating Layer

The charge generating layer is configured to contain, for example, a charge generating material and a binder resin. In addition, the charge generating layer may be configured to include a vapor-deposited film of the charge generating material.

Examples of the charge generating material include phthalocyanine pigments such as non-metal phthalocyanine, chlorogallium phthalocyanine, hydroxygallium phthalocyanine, dichlorotin phthalocyanine, titanyl phthalocyanine, and the like, and in particular, chlorogallium phthalocyanine crystals having strong diffraction peaks at Bragg angles (2θ±0.2°) of at least 7.4°, 16.6°, 25.5°, and 28.3° with respect to CuKα characteristic X rays, non-metal phthalocyanine crystals having strong diffraction peaks at Bragg angles (2θ±0.2°) of at least 7.7°, 9.3°, 16.9°, 17.5°, 22.4°, and 28.8° with respect to CuKα characteristic X rays, hydroxygallium phthalocyanine crystals having strong diffraction peaks at Bragg angles (2θ±0.2°) of at least 7.5°, 9.9°, 12.5°, 16.3°, 18.6°, 25.1°, and 28.3° with respect to CuKα characteristic X rays, and titanyl phthalocyanine crystals having strong diffraction peaks at Bragg angles (2θ±0.2°) of at least 9.6°, 24.1°, and 27.2° with respect to CuKα characteristic X rays. In addition, examples of other charge generating materials include a quinone pigment, a perylene pigment, an indigo pigment, a bisbenzimidazole pigment, an anthrone pigment, a quinacridone pigment, and the like. Moreover, these charge generating materials may be used singly or as a mixture of two or more kinds thereof.

Examples of the binder resins constituting the charge generating layer include polycarbonate resins such as a bisphenol A-type resin, a bisphenol Z-type resin; an acrylic resin; a methacrylic resin; a polyarylate resin; a polyester resin; a polyvinyl chloride resin; a polystyrene resin; an acrylonitrile-styrene copolymer resin; an acrylonitrile-butadiene copolymer; a polyvinyl acetate resin; a polyvinyl formal resin; a polysulfone resin, a styrene-butadiene copolymer resin; a vinylidene chloride-acrylonitrile copolymer resin; a vinyl chloride-vinyl acetate-maleic anhydride resin; a silicone resin; a phenol-formaldehyde resin; a polyacrylamide resin; a polyamide resin; a poly-N-vinylcarbazole resin, and the like. These binder resins may be used singly or as a mixture of two or more kinds thereof.

The blending ratio of the charge generating material to the binder resin is preferably, for example, in a range from 10:1 to 1:10.

When the charge generating layer is formed, coating liquid for forming a charge generating layer obtained by adding the above-described components to the solvent is used.

As a method for dispersing the particles (for example, a charge generating material) in the coating liquid for forming a charge generating layer, media dispersers such as a ball mill, a vibration ball mill, an attritor, a sand mill, a lateral sand mill, or the like, and medialess dispersers such as an agitator, an ultrasonic disperser, a roll mill, a high-pressure homogenizer, or the like are used. Examples of the high-pressure homogenizer include a collision-type homogenizer in which a dispersion is dispersed by liquid-liquid collision, or liquid-wall collision under high pressure, a passing through-type homogenizer in which a dispersion is dispersed by passing the dispersion through fine flow paths under high pressure, and the like.

Examples of the method for applying the coating liquid for forming a charge generating layer onto the undercoat layer include a dip coating method, an extrusion coating method, a wire bar coating method, a spray coating method, a blade coating method, a knife coating method, a curtain coating method, and the like.

The film thickness of the charge generating layer is preferably set in a range of from 0.01 μm to 5 μm, and more preferably from 0.05 μm to 2.0 μm.

Charge Transporting Layer

The charge transporting layer is configured to include the charge transporting material and, as necessary, a binder resin.

Examples of the charge transporting material include, for example, hole transporting materials such as oxadiazole derivatives such as 2,5-bis(p-diethylaminophenyl)-1,3,4-oxadiazole; pyrazoline derivatives such as 1,3,5-triphenylpyrazoline, 1-[pyridyl-(2)]-3-(p-diethylaminostyryl)-5-(p-diethylamino styryl)pyrazoline; aromatic tertiary amino compounds such as triphenylamine, N,N'-bis(3,4-dimethylphenyl)biphenyl-4-amine, tri(p-methylphenyl)-aminyl-4-amine, dibenzylaniline; aromatic tertiary diamino compounds such as N,N'-bis(3-methylphenyl)-N,N'-diphenylbenzidine; 1,2,4-triazine derivatives such as 3-(4'-dimethylaminophenyl)-5,6-di-(4'-methoxyphenyl)-1,2,4-triazine; hydrazone derivatives such as 4-diethylaminobenzaldehyde-1,1-diphenylhydrazone; quinazoline derivatives such as 2-phenyl-4-styryl-quinazoline; benzofuran derivatives such as 6-hydroxy-2,3-di(p-methoxyphenyl)benzofuran; α-stilbene derivatives such as p-(2,2-diphenylvinyl)-N,N-diphenylaniline; enamine derivatives; carbazole derivatives such as N-ethylcarbazole; and poly-N-vinylcarbazole and a derivative thereof; electron transporting materials such as quinone compounds such as chloranil, bromoanthraquinone; a tetracyanoquinodimethane compound; fluorenone compounds such as 2,4,7-trinitrofluorenone, 2,4,5,7-tetranitro-9-fluorenone; xanthone compounds; and thiophene compounds; polymers having a group formed of the above-described compounds in the main chain or side chain thereof; and the like. These charge transporting materials may be used singly or in combination of two or more kinds thereof.

Examples of the binder resin composing the charge transporting layer include insulating resins such as polycarbonate resins such as a bisphenol A-type resin, a bisphenol Z-type resin; an acrylic resin; a methacrylic resin; a polyarylate resin; a polyester resin; a polyvinyl chloride resin; a polystyrene resin; an acrylonitrile-styrene copolymer resin; an acrylonitrile-butadiene copolymer resin, a polyvinyl acetate resin, a polyvinyl formal resin; a polysulfone resin; a styrene-butadiene copolymer resin; a vinylidene chloride-acrylonitrile copolymer resin; a vinyl chloride-vinyl acetate-maleic anhydride resin; a silicone resin; a phenol-formaldehyde resin; a polyacrylamide resin; a polyamide resin; chlorine rubber; organic photoconductive polymers such as polyvinylcarbazole, polyvinylanthracene, polyvinylpyrene; and the like. These binder resins may be used singly or as a mixture of two or more kinds thereof.

Moreover, the blending ratio of the charge transporting material to the binder resin is, for example, preferably from 10:1 to 1:5.

The charge transporting layer is formed by using the coating liquid for forming a charge transporting layer obtained by adding the above-described components to the solvent.

Examples of the method for applying the coating liquid for forming a charge transporting layer onto the charge generating layer include usual methods such as a dip coating method, an extrusion coating method, a wire bar coating method, a spray coating method, a blade coating method, a knife coating method, a curtain coating method, and the like.

The film thickness of the charge transporting layer is preferably set in a range from 5 μm to 50 μm, and more preferably from 10 μm to 40 μm.

Protective Layer

The protective layer is provided on the photosensitive layer, as necessary. For example, in the photoreceptor having a laminate structure, the protective layer is provided in order to prevent chemical change of the charge transporting layer at the time of charging or to further improve a mechanical strength of the photosensitive layer.

Therefore, a layer configured to contain a cross-linked material (cured material) may be preferably applied to the protective layer. Examples of the layer include layers having a known configuration such as a cured layer of a composition containing a reactive charge transporting material and, as necessary, a curable resin and a cured layer in which a charge transporting material is dispersed in a curable resin. In addition, the protective layer may be configured to have a layer in which a charge transporting material is dispersed in a binder resin.

The protective layer is formed by using the coating liquid for forming a protective layer obtained by adding the above-described components to the solvent.

Examples of the method for applying the coating liquid for forming a protective layer onto the charge generating layer include usual methods such as a dip coating method, an extrusion coating method, a wire bar coating method, a spray coating method, a blade coating method, a knife coating method, a curtain coating method, and the like.

The film thickness of the protective layer is, for example, preferably set in a range from 1 μm to 20 μm, and more preferably from 2 μm to 10 μm.

Single-Layer Type Photosensitive Layer

A single-layer type photosensitive layer (charge generating/charge transporting layer) is configured to include, for example, a binder resin, a charge generating material, and a charge transporting material. These materials are the same as those described for the charge generating layer and the charge transporting layer.

In the single-layer type photosensitive layer, the content of the charge generating material is preferably from 10% by weight to 85% by weight, and more preferably from 20% by weight to 50% by weight. In addition, the content of the charge transporting material is preferably from 5% by weight to 50% by weight.

A method for forming the single-layer type photosensitive layer is the same as the methods for forming the charge generating layer and the charge transporting layer. The thickness of the single-layer type photosensitive layer is preferably from 5 μm to 50 μm, and more preferably from 10 μm to 40 μm.

Others

In the electrophotographic photoreceptor according to the exemplary embodiment of the invention, additives such as an antioxidant, a light stabilizer, and a thermal stabilizer may be added to the photosensitive layer or the protective layer for the purpose of prevention of deterioration of the photoreceptor due to ozone or oxidizing gas or light and heat generated in the image forming apparatus.

In addition, at least one kind of electron-accepting materials may be added to the photosensitive layer or the protective layer for the purpose of improving sensitivity, lowering residual potential, lowering fatigue due to repetitive use.

Moreover, silicone oil as a leveling agent may be added to the coating liquid which forms the respective layers of the photosensitive layer and the protective layer, thereby improving the smoothness of the coating film.

Image Forming Apparatus

Next, the image forming apparatus according to the exemplary embodiment of the invention will be described.

An image forming apparatus according to the exemplary embodiment includes the electrophotographic photoreceptor according to the exemplary embodiment; a charging unit that charges the surface of the electrophotographic photoreceptor; an electrostatic latent image forming unit that forms an electrostatic latent image on the surface of the charged electrophotographic photoreceptor; a developing unit that develops the electrostatic latent image formed on the surface of the electrophotographic photoreceptor using toner to form a toner image; and a transfer unit that transfers the toner image formed on the surface of the electrophotographic photoreceptor onto a recording medium.

Figure 7:
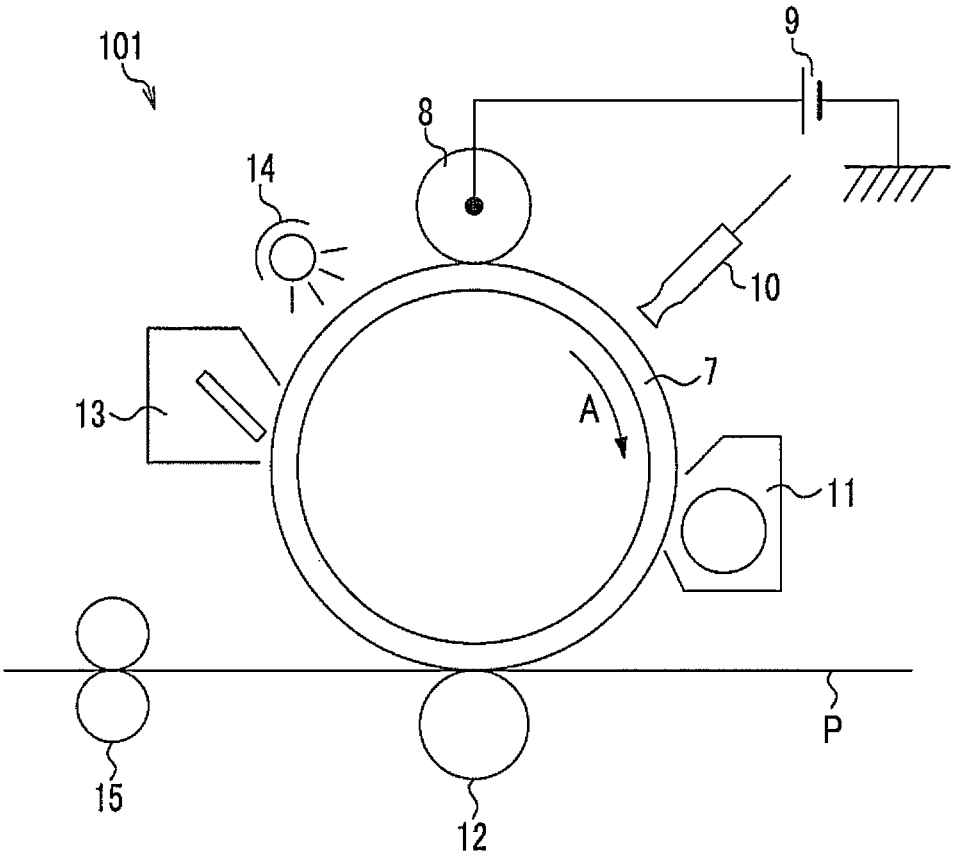
FIG. 7 is a configuration diagram schematically showing an example of an image forming apparatus according to the exemplary embodiment of the invention.

FIG. 7 is a configuration diagram schematically showing an example of an image forming apparatus according to the exemplary embodiment of the invention. An image forming apparatus 101 shown in FIG. 7 includes, for example, a drum-like (cylindrical) electrophotographic photoreceptor 7 according to the exemplary embodiment of the invention which is provided rotatably. A charging device 8, an exposure device 10, a developing device 11, a transfer device 12, a cleaning device 13 and an erasing device (erase device) 14 are disposed, in this order, around the electrophotographic photoreceptor 7, along the movement direction of the outer circumferential surface of the electrophotographic photoreceptor 7, for example. In addition, the cleaning device 13 and the erasing device (erase device) 14 are disposed as necessary.

Charging Device

The charging device 8 is connected to a power source 9 and voltage is applied by the power source 9 so as to charge the surface of the electrophotographic photoreceptor 7.

Examples of the charging device 8 include contact type charging devices using an electroconductive charging roll, a charging brush, a charging film, a charging rubber blade, a charging tube, or the like. In addition, as the charging device 8, a known charging device or the like using a non-contact type roll charging device, a scorotron charging device or corotron charging device using corona discharge, and the like is also used. As the changing device 8, a contact type charging device is preferably used.

Exposure Device

The exposure device 10 exposes the charged electrophotographic photoreceptor 7 to form an electrostatic latent image on the electrophotographic photoreceptor 7.

Examples of the exposure device 10 include optical instruments which expose the surface of the electrophotographic photoreceptor 7 image wise by using light of a semiconductor laser, an LED, a liquid-crystal shutter light or the like. The wavelength of light sources may be in the range of the spectral sensitivity region of the electrophotographic photoreceptor 7. As the wavelength of the semiconductor laser light, for example, near-infrared light having an oscillation wavelength in the vicinity of 780 nm may be preferable. However, the wavelength of the light source is not limited to the above-described wavelength, and lasers having an oscillation wavelength on the order of 600 nm and blue lasers having an oscillation wavelength in from 400 nm to 450 nm may also be used. In addition, as the exposure device 10, for example, surface-emitting type laser light sources which are capable of multi-beam output are also effective to form a color image.

Developing Device

The developing device 11 develops the electrostatic latent image using a developer to form a toner image. It is preferable for the developer to contain toner particles having a volume average particle size of from 3 μm to 9 μm obtained by a polymerization method. The developing device 11 may have a configuration in which a developing roll is disposed in a container containing a two-component developer formed of toner and a carrier so as to face the electrophotographic photoreceptor 7 in a development region.

Transfer Device

The transfer device 12 transfers the toner image developed on the electrophotographic photoreceptor 7 onto a transfer medium.

Examples of the transfer device 12 include known transfer charging devices such as a contact type transfer charging device using a belt, a roller, a film, a rubber blade or the like, a scorotron transfer charging device or a corotron transfer charging device using corona discharge, and the like.

Cleaning Device

The cleaning device 13 removes residual toner on the electrophotographic photoreceptor 7 after transferring.

It is preferable that the cleaning device 13 have a cleaning blade which comes into contact with the electrophotographic photoreceptor 7 at a linear pressure of from 10 g/cm to 150 g/cm. For example, the cleaning device 13 is configured to include a case body, a cleaning blade, and a cleaning brush disposed at the upstream side of the cleaning blade in a rotational direction of the electrophotographic photoreceptor 7. In addition, a solid lubricant is disposed on the cleaning brush in a contact manner.

Erasing Device

The erasing device (erase device) 14 erases residual potential on the surface of the electrophotographic photoreceptor 7 by irradiating the surface of the electrophotographic photoreceptor 7 after transferring the toner image with erase light. For example, the erasing device 14 erases a potential difference between the exposure section and non-exposure section which is generated on the surface of the electrophotographic photoreceptor 7 by the exposure device 10, by irradiating the entire regions of the electrophotographic photoreceptor 7 in the axial direction and the width direction with erase light.

Light sources of the erasing device 14 are not particularly limited and examples thereof include a tungsten lamp (for example, white light), a light-emitting diode (LED: for example, red light) and the like.

Fixing Device

The image forming apparatus 100 includes a fixing device 15 that fixes the toner image to recording paper P after the transferring process. The fixing device is not particularly limited and examples thereof include known fixing devices such as a heat roller fixing device and an oven fixing device.

Next, an operation of an image forming apparatus 101 according to the exemplary embodiment of the invention will be described. First, the electrophotographic photoreceptor 7 rotates along the direction represented by the arrow A and is negatively charged by the charging device 8.

The electrophotographic photoreceptor 7, of which the surface is negatively charged by the charging device 8, is exposed by the exposure device 10 to form an electrostatic latent image on the surface thereof.

When a portion of the electrophotographic photoreceptor 7 on which the electrostatic latent image is formed comes close to the developing device 11, toner is attached to the electrostatic latent image by the developing device 11 so as to form a toner image.

When the electrophotographic photoreceptor 7 on which the toner image is formed further rotates in the direction of the arrow A, the toner image is transferred to the recording paper P by the transfer device 12. As a result, the toner image is formed on the recording paper P.

The toner image is fixed to the recording paper P on which the image is formed, by the fixing device 15.

Process Cartridge

The image forming apparatus according to the exemplary embodiment of the invention may have a configuration in which a process cartridge including the electrophotographic photoreceptor 7 according to the exemplary embodiment of the invention is detachably attached to the image forming apparatus.

It is sufficient that the process cartridge according to the exemplary embodiment of the invention be configured to include the electrophotographic photoreceptor 7 according to the exemplary embodiment of the invention at least. In addition to the electrophotographic photoreceptor 7, the process cartridge according to the exemplary embodiment of the invention may be configured to include, for example, at least one of constituent members selected from the charging device 8, the exposure device 10, the developing device 11, the transfer device 12, the cleaning device 13 and the erasing device 14.

The image forming apparatus according to the exemplary embodiment is not limited to the above-described configuration. For example, in order to make uniform polarity of the residual toner and facilitate cleaning with the cleaning brush or the like, a first erasing device may be provided around the electrophotographic photoreceptor 7 so as to be disposed at the downstream side of the transfer device 12 in the rotational direction of the electrophotographic photoreceptor 7 and the upstream side of the cleaning device 13 in the rotational direction of the electrophotographic photoreceptor 7. Further, in order to erase the electricity of the surface of the electrophotographic photoreceptor 7, a second erasing device may be provided at the downstream side of the cleaning device 13 in the rotational direction of the electrophotographic photoreceptor 7 and the upstream side of the charging device 8 in the rotational direction of the electrophotographic photoreceptor 7.

The image forming apparatus according to the exemplary embodiment of the invention is not limited to the above-described configuration and a known configuration may be employed. For example, an intermediate transfer type image forming apparatus, in which the toner image formed on the electrophotographic photoreceptor 7 is transferred to an intermediate transfer body and then is transferred to the recording paper P, or a tandem type image forming apparatus may be also employed.

The electrophotographic photoreceptor according to the exemplary embodiment of the invention may be applied to an image forming apparatus that does not include an erasing device.

EXAMPLES

Hereinafter, the exemplary embodiment of the invention will be further described in detail based on Examples and Comparative Examples, but the exemplary embodiment of the invention is not limited to Examples described below.

Surface Treatment Example 1

100 parts by weight of zinc oxide (trade name: MZ-300, manufactured by Tayca Corporation) as metal oxide particles, 10 parts by weight of toluene solution containing 10% by weight of N-β-(aminoethyl)-γ-aminopropyltrimethoxysilane as a coupling agent, and 200 parts by weight of toluene are mixed and the mixture is stirred, followed by performing reflux for 2 hours. Thereafter, the toluene is distilled off under reduced pressure of 10 mmHg, and the residue is baked at 135° C. for 2 hours.

Surface Treatment Examples 2 to 5

The same process as the surface treatment example 1 is carried out, except that the condition is changed according to Table 1.

Example 1

33 parts by weight of zinc oxide surface-treated in the surface treatment example 1, 6 parts by weight of blocked isocyanate SUMIDUR 3175 (manufactured by Sumitomo Bayer Urethane Co., Ltd.), 0.7 part by weight of the electron accepting compound (exemplary compound (1-2)) and 25 parts by weight of methyl ethyl ketone are mixed for 30 minutes. Thereafter, 5 parts by weight of a butyral resin "S-LEC BM-1 (manufactured by Sekisui Chemical Co., Ltd.)", 3 parts by weight of silicone ball TOSPEARL 130 (manufactured by GE Toshiba Silicones Co., Ltd.) and 0.01 part by weight of leveling agent Silicon Oil "SH29PA (manufactured by Dow Corning Toray Silicone Co., Ltd.)" are added thereto and the mixture is dispersed for 2 hours by using a sand mill. Thus, a dispersion (coating liquid for forming an undercoat layer) is obtained.

Further, this coating liquid is applied onto an aluminum substrate having a diameter of 40 mm, a length of 357 mm and a thickness of 2 mm, by a dip coating method and drying and curing are carried out at 180° C. for 30 minutes. Thus, an undercoat layer having a thickness of 20 μm is obtained.

Next, hydroxygallium phthalocyanine is used as a charge generating material and a mixture comprising 15 parts by weight of hydroxygallium phthalocyanine, 10 parts by weight of vinyl chloride-vinyl acetate copolymer resin (VMCH, manufactured by Nippon Unicar Co., Ltd.) and 300 parts by weight of n-butyl alcohol is dispersed for 4 hours by using a sand mill. The obtained dispersion is applied onto the undercoat layer by dip coating and dried at 100° C. for 10 minutes. Thus, a charge generating layer having a film thickness of 0.2 μm is formed.

Further, coating liquid, which is obtained by adding and dissolving 4 parts by weight of N,N'-diphenyl-N,N'-bis(3-methylphenyl)-[1,1']biphenyl-4,4'-diamine and 6 parts by weight of bisphenol Z polycarbonate resin (viscosity average molecular weight: 40,000) into 25 parts by weight tetrahydrofuran and 5 parts by weight of chlorobenzene, is formed onto the charge generating layer and dried at 130° C. for 40 minutes. Thus, a charge transporting layer having a film thickness of 35 μm is formed.

Through the above-described processes, a photoreceptor is obtained.

The measurement of the AC impedances of the undercoat layer of the obtained photoreceptor at frequencies of 1 Hz and 100 Hz is carried out according to the above-described method. The results are shown in Table 2.

In addition, the obtained photoreceptor is mounted on "DocuCentre II 7500" manufactured by Fuji Xerox Co., Ltd.

TABLE 1

| | Metal oxide particles | | | Coupling agent name | |
|---|---|---|---|---|---|
| Surface treatment example No. | Material name | Trade name | Amount (part by weight) | Material name | Amount of toluene solution containing 10% by weight (part by weight) |
| 1 | Zinc oxide | MZ-300: manufactured by Tayca Corporation | 100 | N-β-(aminoethyl)-γ-aminopropyltrimethoxysilane | 10 |
| 2 | Zinc oxide | MZ-300: manufactured by Tayca Corporation | 100 | N-β-(aminoethyl)-γ-aminopropyltrimethoxysilane | 15 |
| 3 | Zinc oxide | MZ-300: manufactured by Tayca Corporation | 100 | N-β-(aminoethyl)-γ-aminopropyltrimethoxysilane | 20 |
| 4 | Titanium oxide | TAF 500J: manufactured by Fuji Titanium Co., Ltd. | 100 | N-β-(aminoethyl)-γ-aminopropyltrimethoxysilane | 10 |
| 5 | Tin oxide | S1: manufactured by Mitsubishi Materials Corporation | 100 | N-β-(aminoethyl)-γ-aminopropyltrimethoxysilane | 10 |
| 6 | Zinc Oxide | MZ-300: manufactured by Tayca Corporation | 100 | 3-aminopropyltrimethoxysilane | 10 |

(apparatus equipped with a contact type charging roll as a charging device) and the following evaluations are carried out. The results are shown in Table 2.

Evaluation of Ghost

For the evaluation of the ghost, a chart shown in FIG. 8 is outputted under the environment of 28° C. and 80% RH, 300,000 sheets of images having an image density of each color of 5% are outputted and thereafter the chart shown in FIG. 8 is outputted again. The charts are set to be a firstly outputted image (initial image) and an image after 300,000th outputting (image after outputting 300,000 sheets), respectively, and then the evaluation is carried out by visual observation, based on the following criteria.

Figure 8:
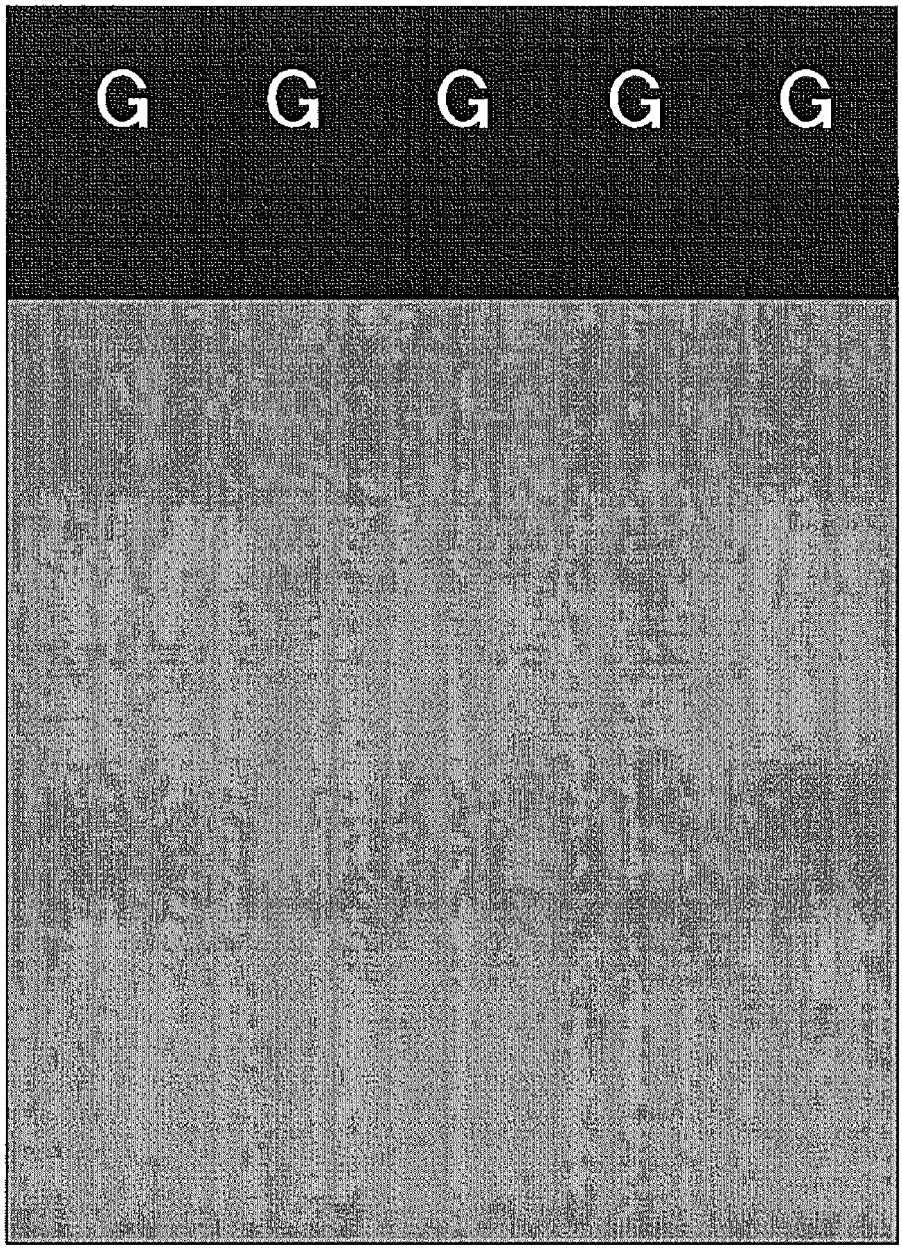
FIG. 8 is a schematic view showing a chart used in a ghost evaluation in Examples.

In addition, the chart shown in FIG. 8 is a chart in which a region having outlined white letters "G" in the black solid image having an image density of 100% and a region of the halftone image having an image density of 40% are printed.

The evaluation criteria are as follows.

A: Ghost is not generated.

B: Ghost is slightly generated but there is no problem for practical use.

C: Ghost is generated and is not acceptable in terms of the image quality.

Evaluation of Halftone Image Density Unevenness

For the evaluation of the halftone image density unevenness, a halftone image having an image density of 30% is outputted under the environment of 28° C. and 80% RH, 300,000 sheets of images having an image density of each color of 5% are outputted and thereafter the halftone image having an image density of 30% is outputted again. The halftone images are set to be a firstly outputted image (initial image) and an image after 300,000th outputting (image after outputting 300,000 sheets), respectively, and then the evaluation is carried out by visual observation.

The evaluation criteria are as follows.

A: Image density unevenness is not generated.

B: Image density unevenness is slightly generated but there is no problem for practical use.

C: Image density unevenness is generated and is not acceptable in terms of the image quality.

Evaluation of Fogging

For the evaluation of the fogging, a solid image having a size of 1 cm×10 cm and an image density of 100% is outputted under the environment of 28° C. and 80% RH, 300,000 sheets of images having an image density of each color of 5% are outputted and thereafter the solid image is outputted again. The solid images are set to be a firstly outputted image (initial image) and an image after 300,000th outputting (image after outputting 300,000 sheets), respectively, and then the evaluation is carried out by visual observation.

The evaluation criteria are as follows.

A: Fogging is not generated.

B: Fogging is slightly generated but there is no problem for practical use.

C: Fogging is generated and is not acceptable in terms of the image quality.

Evaluation of Residual Potential

For the residual potential of the photoreceptor obtained in each Example, the following measurement is carried out.

After the evaluations of the ghost, the halftone image density unevenness, and the fogging are finished, a developer unit is detached, a potential probe is disposed at the position of the developer unit, a solid image having an image density of 100% is outputted and then a residual potential is measured.

Then, after the evaluation of the halftone image density unevenness is finished (after outputting 300,000 sheets), the above-described measurement is carried out. The difference between the obtained residual potential and the initial residual potential is set to be an increment of the residual potential and then the evaluation of the residual potential is carried out.

Examples 2 to 5

A photoreceptor is prepared and then the evaluations are carried out in a similar way to Example 1, except that the metal oxide particles, which are subjected to the surface treatment in the surface treatment examples 2, 3, 4, and 5, are respectively used in the formation of the undercoat layer. The results are shown in Table 2.

Example 6

A photoreceptor is prepared and then the evaluations are carried out in a similar way to Example 1, except that 1 part by weight of the exemplary compound (1-9) as the electron accepting compound is used in the formation of the undercoat layer. The results are shown in Table 2.

Example 7

A photoreceptor is prepared and then the evaluations are carried out in a similar way to Example 1, except that 1.5 parts by weight of the exemplary compound (1-14) as the electron accepting compound is used in the formation of the undercoat layer. The results are shown in Table 2.

Example 8

A photoreceptor is prepared and then the evaluations are carried out in a similar way to Example 1, except that 1 part by weight of the exemplary compound (1-21) as the electron accepting compound is used in the formation of the undercoat layer. The results are shown in Table 2.

Example 9

A photoreceptor is prepared and then the evaluations are carried out in a similar way to Example 5, except that the drying temperature is changed to be 190° C. in the formation of the undercoat layer. The results are shown in Table 2.

Example 10

A photoreceptor is prepared and then the evaluations are carried out in a similar way to Example 1, except that the metal oxide particles, which are subjected to the surface treatment in the surface treatment example 6, are used in the formation of the undercoat layer. The results are shown in Table 2.

Comparative Example 1

A photoreceptor is prepared and then the evaluations are carried out in a similar way to Example 1, except that MZ-300 (manufactured by Tayca Corporation: without the surface treatment) as zinc oxide is used in the formation of the undercoat layer. The results are shown in Table 2.

Comparative Example 2

A photoreceptor is prepared and then the evaluations are carried out in a similar way to Example 1, except that the electron accepting compound (exemplary compound (1-2)) is not used in the formation of the undercoat layer. The results are shown in Table 2.

Comparative Example 3

A photoreceptor is prepared and then the evaluations are carried out in a similar way to Example 1, except that S1 (manufactured by Mitsubishi Materials Corporation: without the surface treatment) as tin oxide is used and the electron accepting compound (exemplary compound (1-2)) is not used in the formation of the undercoat layer. The results are shown in Table 2.

Comparative Example 4

A photoreceptor is prepared and then the evaluations are carried out in a similar way to Comparative Example 3, except that the drying temperature is changed to be 190° C. in the formation of the undercoat layer. The results are shown in Table 2.

Comparative Example 5

A photoreceptor is prepared and then the evaluations are carried out in a similar way to Example 1, except that the electron accepting compound (exemplary compound (1-2)) is not used and the drying temperature is changed to be 190° C. in the formation of the undercoat layer. The results are shown in Table 2.

Comparative Example 6

A photoreceptor is prepared and then the evaluations are carried out in a similar way to Comparative Example 3, except that the film thickness of the undercoat layer is changed to be 30 μm in the formation of the undercoat layer. The results are shown in Table 2.

From the above results, in Examples, it is found that the ghost is suppressed regarding to the initial image and the image after outputting 300,000 sheets, compared to Comparative Examples.

In addition, in Examples, it is found that the density unevenness of the halftone image and the fogging are also suppressed regarding to the initial image and the image after outputting 300,000 sheets, compared to Comparative Examples.

Moreover, in Examples, it is found that the increase in the residual potential is suppressed, compared to Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

an electroconductive substrate;

an undercoat layer that is provided on the electroconductive substrate, contains a binder resin, metal oxide particles and an electron accepting compound having an acidic group and has an AC impedance of from $1\times10^5\Omega$ to $1\times10^8\Omega$ under the measurement condition in which a temperature is 22° C., a humidity is 50% RH, an AC

TABLE 2

| | Undercoat layer composition | | | | | Evaluation | | | | | | |
|---|---|---|---|---|---|---|---|---|---|---|---|---|
| | Metal oxide particles | | | Undercoat layer AC impedance | | Initial image | | | Image after outputting 300,000 sheets | | | Residual potential |
| | Material name | Surface treatment example No. | Electron accepting compound | Frequency 100 Hz (Ω) | Frequency 1 Hz (Ω) | Ghost | Density unevenness | Fogging | Ghost | Density unevenness | Fogging | (increment: V) |
| Example 1 | Zinc oxide | 1 | 1-2 | $7\times10^6$ | $3\times10^7$ | A | A | A | A | A | A | 20 |
| Example 2 | Zinc oxide | 2 | 1-2 | $4\times10^7$ | $8\times10^7$ | A | A | A | A | A | A | 35 |
| Example 3 | Zinc oxide | 3 | 1-2 | $6\times10^7$ | $1\times10^8$ | A | A | A | A | A | A | 25 |
| Example 4 | Titanium oxide | 4 | 1-2 | $1\times10^7$ | $8\times10^7$ | A | A | A | B | B | B | 40 |
| Example 5 | Tin oxide | 5 | 1-2 | $3\times10^3$ | $8\times10^5$ | A | A | A | B | A | A | 10 |
| Example 6 | Zinc oxide | 1 | 1-9 | $5\times10^6$ | $4\times10^7$ | A | A | A | A | A | A | 15 |
| Example 7 | Zinc oxide | 1 | 1-14 | $2\times10^5$ | $6\times10^6$ | A | A | A | A | A | A | 25 |
| Example 8 | Zinc oxide | 1 | 1-21 | $5\times10^6$ | $3\times10^7$ | A | A | A | A | A | A | 45 |
| Example 9 | Tin oxide | 5 | 1-2 | $1\times10^3$ | $2\times10^5$ | A | A | A | A | A | B | 10 |
| Example 10 | Zinc oxide | 6 | 1-2 | $8\times10^6$ | $1\times10^6$ | A | A | A | A | B | A | 20 |
| Comparative Example 1 | Zinc oxide | n/a | 1-2 | $4\times10^7$ | $3\times10^8$ | C | A | C | C | B | C | 15 |
| Comparative Example 2 | Zinc oxide | 1 | n/a | $8\times10^8$ | $8\times10^9$ | C | A | A | C | C | C | 150 |
| Comparative Example 3 | Tin oxide | n/a | n/a | $6\times10^2$ | $8\times10^4$ | C | A | C | C | A | C | 25 |
| Comparative Example 4 | Tin oxide | n/a | n/a | $2\times10^3$ | $5\times10^4$ | C | A | C | C | A | C | 20 |
| Comparative Example 5 | Zinc oxide | 1 | n/a | $4\times10^7$ | $3\times10^5$ | C | A | C | C | B | C | 15 |
| Comparative Example 6 | Tin oxide | n/a | n/a | $8\times10^2$ | $1\times10^5$ | C | A | C | C | A | C | 25 |

voltage is ±1 V, and a frequency is 1 Hz and an AC impedance of from $1\times10^3\Omega$ to $1\times10^8\Omega$ under the measurement condition in which a temperature is 22° C., a humidity is 50% RH, an AC voltage is ±1 V, and a frequency is 100 Hz; and a photosensitive layer that is provided on the undercoat layer.

2. The electrophotographic photoreceptor according to claim 1, wherein the AC impedance under the measurement condition in which a temperature is 22° C., a humidity is 50% RH, an AC voltage is ±1 V, and a frequency is 1 Hz is from $1\times10^4\Omega$ to $1\times10^7\Omega$.

3. The electrophotographic photoreceptor according to claim 1, wherein the AC impedance under the measurement condition in which a temperature is 22° C., a humidity is 50% RH, an AC voltage is ±1 V, and a frequency is 100 Hz is from $5\times10^3\Omega$ to $1\times10^7\Omega$.

4. The electrophotographic photoreceptor according to claim 1, wherein the AC impedance under the measurement condition in which a temperature is 22° C., a humidity is 50% RH, an AC voltage is ±1 V, and a frequency is from 1 Hz to 100 Hz is from $1\times10^3\Omega$ to $1\times10^8\Omega$.

5. The electrophotographic photoreceptor according to claim 1, wherein the electron accepting compound is an anthraquinone derivative.

6. The electrophotographic photoreceptor according to claim 5, wherein the anthraquinone derivative is the compound represented by the following Formula (1):

Formula (1)

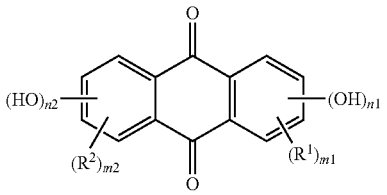

wherein in Formula (1), n1 and n2 each independently represent an integer of from 0 to 3, provided that at least one of n1 and n2 represents an integer of from 1 to 3; m1 and m2 each independently represent an integer of 0 or 1; and $R^1$ and $R^2$ each independently represent an alkyl group having from 1 to 10 carbon atoms or an alkoxy group having from 1 to 10 carbon atoms.

7. The electrophotographic photoreceptor according to claim 1, wherein the metal oxide particles are at least one selected from the group consisting of zinc oxide, titanium oxide and tin oxide.

8. The electrophotographic photoreceptor according to claim 1, wherein the metal oxide particles are zinc oxide.

9. A process cartridge detachable from an image forming apparatus, the process cartridge comprising the electrophotographic photoreceptor according to claim 1.

10. The process cartridge according to claim 9, further comprising a contact type charging unit that charges a surface of the electrophotographic photoreceptor.

11. An image forming apparatus comprising:

the electrophotographic photoreceptor according to claim 1;

a charging unit that charges a surface of the electrophotographic photoreceptor;

an electrostatic latent image forming unit that forms an electrostatic latent image on the surface of a charged electrophotographic photoreceptor;

a developing unit that develops the electrostatic latent image formed on the surface of the electrophotographic photoreceptor using toner to form a toner image; and a transfer unit that transfers the toner image formed on the surface of the electrophotographic photoreceptor onto a recording medium.

12. The image forming apparatus according to claim 11, wherein the charging unit is a contact type charging unit.

* * * * *